US006379270B2

(12) United States Patent
Maruko et al.

(10) Patent No.: US 6,379,270 B2
(45) Date of Patent: Apr. 30, 2002

(54) GOLF BALL

(75) Inventors: Takashi Maruko; Yutaka Masutani, both of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/340,185

(22) Filed: Jun. 28, 1999

(30) Foreign Application Priority Data

Jun. 26, 1998 (JP) ..... 10-196701

(51) Int. Cl.[7] ..... A63B 37/04; A63B 37/06

(52) U.S. Cl. ..... 473/377; 473/367; 473/368; 473/371; 473/374; 473/378; 473/600; 473/601; 473/602

(58) Field of Search ..... 473/367, 368, 473/371, 374, 377, 378, 600, 601, 602

(56) References Cited

U.S. PATENT DOCUMENTS

| | | | | | |
|---|---|---|---|---|---|
| 698,516 | A | * | 4/1902 | Kempshall | |
| 1,242,832 | A | * | 10/1917 | Martin et al. | |
| 1,482,232 | A | * | 1/1924 | Hazeltine | 473/377 |
| 1,524,171 | A | * | 1/1925 | Shatfield | |
| 1,855,448 | A | * | 4/1932 | Hazeltine | |
| 2,376,085 | A | * | 5/1945 | Radford | |
| 2,500,326 | A | * | 3/1950 | Shaff | |
| 4,203,941 | A | * | 5/1980 | Brooker | 264/250 |
| 4,229,401 | A | * | 10/1980 | Pocklington | 264/248 |
| 4,367,873 | A | * | 1/1983 | Chang et al. | 473/602 |
| 5,407,341 | A | * | 4/1995 | Endo | 425/116 |
| 5,439,227 | A | * | 8/1995 | Egashira et al. | 473/373 |
| 5,490,674 | A | | 2/1996 | Hamada et al. | |
| 5,692,973 | A | * | 12/1997 | Dalton | 473/374 |
| 5,782,702 | A | * | 7/1998 | Yamagishi et al. | 473/280 |
| 5,820,485 | A | * | 10/1998 | Hwang | 473/361 |
| 5,830,086 | A | * | 11/1998 | Hayashi | 473/376 |
| 5,836,834 | A | * | 11/1998 | Matsutani et al. | 473/374 |
| 6,033,611 | A | * | 3/2000 | Yamaguchi | 264/250 |

* cited by examiner

*Primary Examiner*—Peter Vo
*Assistant Examiner*—Paul D. Kim
(74) *Attorney, Agent, or Firm*—Sughrue Mion, PLLC

(57) ABSTRACT

In a golf ball comprising a solid core, an intermediate layer, and a cover, the solid core or the cover is provided with a plurality of protrusions penetrating into the intermediate layer. Provided the protrusions are spaced apart a distance X (mm) and have a length L (mm), those protrusions satisfying $L \leqq X \leqq 5L$ account for at least 60% of the entire protrusions. The protrusions penetrating into the intermediate layer optimizes the buckling phenomenon whereby the ball is improved in flight performance, control and feel.

17 Claims, 1 Drawing Sheet

GOLF BALL

This invention relates to a golf ball comprising a solid core, an intermediate layer, and a cover which exhibits improved flight performance, control and feel.

BACKGROUND OF THE INVENTION

A variety of studies and proposals have been made to find a good compromise between flight distance and control of golf balls. For solid golf balls comprising a solid core and a cover, one common approach is to adjust the hardness and dimensions (including diameter and gage) of the core and the cover.

For example, U.S. Pat. No. 5,439,227 discloses a three-piece golf ball comprising a core, a cover inner layer and a cover outer layer, the cover outer layer being harder than the cover inner layer. U.S. Pat. No. 5,490,674 discloses a three-piece golf ball comprising a solid core of inner and outer layers and a cover, the core inner layer being harder than the core outer layer.

While the respective layers of most golf balls define smooth spherical surfaces, the golf balls disclosed in U.S. Pat. Nos. 2,376,085 and 5,692,973 have a core which is provided with outwardly extending protrusions for preventing the core from being offset during injection molding of the cover therearound. The protrusions in these golf balls are substitutes for the support pins used during injection molding. These patents do not attempt to positively utilize the shape effect of support pin-substituting protrusions, but rather intend to prevent offsetting and to avoid incorporation of a distinct material in the cover. By forming the protrusions from the same material as the cover so that the cover may have a uniform thickness, the protrusions are eventually integrated with the cover. The protrusions themselves do not govern ball performance.

SUMMARY OF THE INVENTION

An object of the invention is to provide a golf ball wherein the solid core or the cover partially penetrates into the intermediate layer to form protrusions therein so that the ball is given excellent flight performance, control and feel.

The inventor paid attention to the shape effects of the respective layers constituting a golf ball, especially the buckling phenomenon of protrusions extending from the cover or solid core into the intermediate layer that as the axial compressive load applied to a protrusion increases, uniform compression becomes unstable and is shifted laterally whereby the protrusion is bent. It has been found that a golf ball comprising a solid core, an intermediate layer, and a cover wherein the solid core or the cover is provided with a plurality of protrusions penetrating into the intermediate layer and the protrusions are spaced apart a distance X (mm) from each other and have a length L (mm) is improved in flight performance, control and feel when at least 60% of the protrusions are formed so as to satisfy $L \leqq X \leqq 5L$, and preferably the solid core or the cover that is provided with a plurality of protrusions has a higher hardness than the intermediate layer. The construction where the protrusions of specific spacing-length relationship on the solid core or cover penetrate into the intermediate layer has the following advantages. When the ball is hit with a driver or similar club at a relatively high head speed, the protrusions are bent and the ball is largely deformed, which provides a reduced spin rate and an increased launch angle, resulting in an increased carry. When the ball is hit with a short iron or similar club at a relatively low head speed, the protrusions are not substantially bent and the ball is restrained from deformation, which provides an increased backspin rate and maintains ease of control. With respect to the feel of the ball when hit, the ball gives a soft feel upon driver shots and a tight, full-body, pleasant feel upon short iron shots. In order that the protrusions exert the unique performance as mentioned above when hit with a driver at a relatively high head speed, the protrusions must be arranged at a sufficient spacing to avoid mutual interference so that the protrusions are sufficiently deformable. For at least 60% of the protrusions, their spacing X and length L must satisfy $L \leqq X \leqq 5L$.

Accordingly, the present invention provides a golf ball comprising a solid core, an intermediate layer, and a cover, wherein the solid core or the cover is provided with a plurality of protrusions penetrating into the intermediate layer, the protrusions are spaced apart a distance X (mm) from each other and have a length L (mm), and those protrusions satisfying $L \leqq X \leqq 5L$ account for at least 60% of the entire protrusions.

Preferably, the protrusions have a length L of 1 to 6 mm. Also preferably, the protrusions have a maximum size in cross section of 0.5 to 5 mm. The solid core or the cover that is provided with a plurality of protrusions preferably has a higher hardness than the intermediate layer, with a hardness difference being at least 6 Shore D hardness units. Typically, the solid core is formed mainly of 1,4-cis-polybutadiene, the intermediate layer is formed mainly of a polyester elastomer or polyurethane resin, and the cover is formed mainly of an ionomer resin.

DESCRIPTION OF PREFERRED EMBODIMENTS

Figure 1:
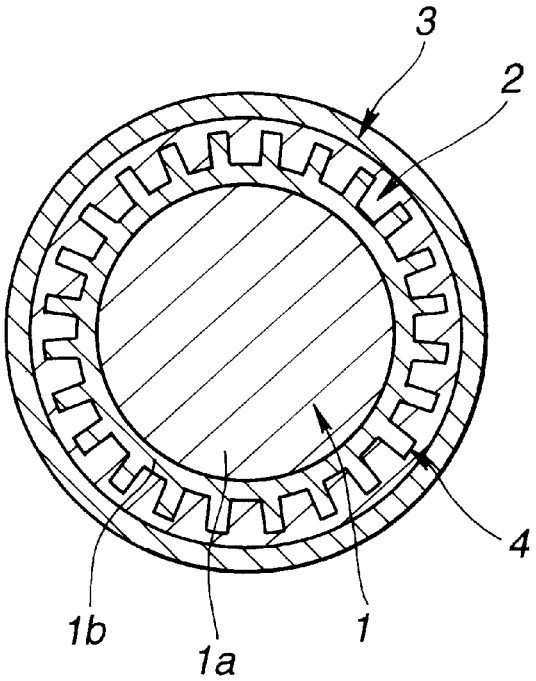
FIG. 1 is a schematic cross-sectional view of a golf ball in which protrusions extend from a solid core according to one embodiment of the invention.
Figure 2:
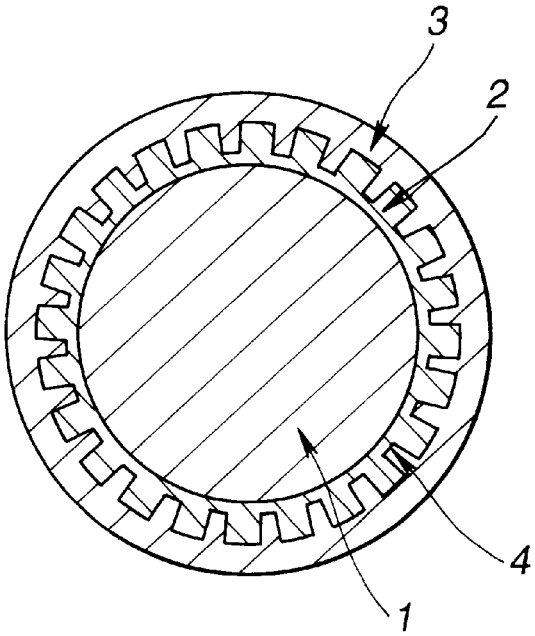
FIG. 2 is a schematic cross-sectional view of a golf ball in which protrusions extend from a cover according to another embodiment of the invention.

Referring to FIGS. 1 and 2, the golf ball of the invention is illustrated as a multilayer golf ball comprising a solid core 1, an intermediate layer 2 enclosing the core 1, and a cover 3 enclosing the intermediate layer 2. The core 1 and cover 3 each may consist of either a single layer or plural layers. All of these components are disposed in a concentric fashion. The solid core 1 shown in FIG. 1 is of two-layer construction consisting of an inner core 1*a* and an outer layer 1*b* enclosing the inner core. According to the invention, at least one of the solid core 1 and the cover 3 is provided with a plurality of convex protrusions 4 that penetrate into the intermediate layer 2. In the embodiment of FIG. 1, the outer layer 1*b* of the solid core 1 is provided at its outer surface with protrusions 4. In the embodiment of FIG. 2, the cover 3 is provided at its inner surface with protrusions 4. The intermediate layer 2 is provided with a corresponding plurality of recesses so that the protrusions 4 are closely fitted and embedded in the recesses.

According to the invention, the protrusions 4 are formed on at least one of the core and the cover. Provided that the protrusions are spaced apart a distance X (mm) from each other and have a length L (mm), at least 60%, preferably at least 80% of the entire protrusions should satisfy the relationship: $L \leqq X \leqq 5L$, preferably $L \leqq X \leqq 4L$ and more preferably $L \leqq X \leqq 3L$ The distance X is the distance or spacing between one protrusion and a protrusion positioned nearest to the one protrusion. The length L is the length between the top and the base of the protrusion as measured in a radial direction from the center of the ball. If the distance X is less than the length L, the protrusions would interfere each other when they are deformed, and thus become less effective. X greater than 5L indicates that the protrusions are distributed so sparse, failing to maintain the symmetry requisite for the golf ball.

In the golf ball of the invention, the distribution and size of the protrusions 4 are selected such that the spacing X falls within the specific range relative to the length L. This selection optimizes the buckling phenomenon of the protrusions in response to both driver shots at a relatively high head speed and iron shots at a relatively low head speed, endowing the ball with excellent flight performance, control and feel, which have never been available with prior art solid golf balls.

In the embodiments of FIGS. 1 and 2, the protrusions 4 are formed on either the core or the cover. Insofar as the spacing X and the length L of protrusions satisfy the specific relationship, the protrusions are not particularly limited and may be formed on both the core and the cover if desired. Preferred examples of the protrusions are described below with respect to their geometry, dimension, distribution, etc.

The ball performance is further improved when the protrusions have a length L of 1 to 6 mm, especially 1 to 4 mm in the radial direction from the ball center, and a maximum size of 0.5 to 5 mm, especially 1 to 3 mm in a cross section taken perpendicular to the radial direction. If the protrusion length L is less than 1 mm, the effect of the protrusions would become insufficient. The protrusions with a length L of more than 6 mm would adversely affect resilience. If the maximum size in cross section of the protrusions is less than 0.5 mm, the protrusions would have an insufficient strength and become less effective. If the maximum size in cross section of the protrusions is more than 5 mm, it would become difficult to maintain symmetry. The intermediate layer in which the protrusions are embedded preferably has a thickness of 1.0 to 7.0 mm, more preferably 1.5 to 4.0 mm, where,-no recesses are formed. The ratio of the protrusion, length to the intermediate layer thickness is preferably from 0.4 to 1.0, more preferably from 0.6 to 1.0. The shape of protrusions is selected as appropriate, for example, from among cylinder, cone, prism, pyramid, frusto-cone and frusto-pyramid shapes. The maximum size in cross section of the protrusions is usually the size of the cross section of the protrusions at their base, which is a diameter for the circular planar shape, the longest side for the triangular planar shape, or the longest diagonal for the rectangular and other non-circular planar shapes. The total number of protrusions is usually about 75 to about 500, preferably about 80 to about 400. The protrusions are distributed on the spherical outer surface of the relevant layer, preferably as uniformly as possible, in an appropriate arrangement, for example, a regular octahedral, regular dodecahedral or regular icosahedral arrangement.

In the golf ball of the invention, the material of which the solid core is made contains a base rubber such as 1,4-cis-polybutadiene, polyisoprene, natural rubber or silicone rubber as a main component. It is recommended to use 1,4-cis-polybutadiene as the main component in order to enhance resilience.

In the rubber composition, a crosslinking agent may be blended with the rubber component. Exemplary crosslinking agents are zinc and magnesium salts of unsaturated fatty acids such as zinc methacrylate and zinc acrylate, and esters such as trimethylpropane methacrylate. Of these, zinc acrylate is preferred because it can impart high resilience. The crosslinking agent is preferably used in an amount of about 15 to 40 parts by weight per 100 parts by weight of the base rubber. A vulcanizing agent may also be blended, preferably in an amount of about 0.1 to 5 parts by weight per 100 parts by weight of the base rubber. In the rubber composition, zinc oxide or barium sulfate may be blended as an antioxidant or specific gravity adjusting filler. The amount of filler blended is preferably about 5 to 130 parts by weight per 100 parts by weight of the base rubber.

One preferred formulation of the solid core-forming rubber composition is given below.

| | Parts by weight |
|---|---|
| 1,4-cis-polybutadiene | 100 |
| Zinc oxide | 5 to 40 |
| Zinc acrylate | 15 to 40 |
| Barium sulfate | 0 to 40 |
| Peroxide | 0.1 to 5.0 |

Vulcanizing conditions include a temperature of 150±10° C. and a time of about 5 to 20 minutes.

The rubber composition is obtained by kneading the above-mentioned components in a conventional mixer such as a kneader, Banbury mixer or roll mill. The resulting compound is molded in a mold by injection or compression molding.

When the core is provided with protrusions as shown in FIG. 1, the core is preferably constructed to a multilayer structure consisting of an inner core and one or more surrounding outer layers wherein the outermost layer is provided with protrusions. The inner core may be formed of the same rubber composition as the core-forming rubber composition mentioned above. The outer layer(s) may also be formed of rubber-base materials, but preferably of resin-base materials, for example, ionomer resins, amide resins such as nylon, urethane resins, and polyester elastomers (e.g., Hytrel). The ratio of the thickness (mm) of the outer layer (the thickness of the portion of the outer layer where no protrusions are formed) to the diameter (mm) of the inner core is preferably from about 1:9 to about 1:72, more preferably from about 1:11 to about 1:36.

Preferably, the solid core has a diameter of about 28 to 38 mm, more preferably about 30 to 37 mm (excluding the protrusions in the embodiment of FIG. 1), a Shore D hardness of about 20 to 50, more preferably about 25 to 45, a deflection of about 2.5 to 5.0 mm, more preferably about 3.0 to 4.5 mm under a load of 100 kg, and a weight of about 12 to 35.0 g.

Where the protrusions 4 are formed so-as to extend radially outward from the core 1 (that is, the core partially penetrates into the intermediate layer) as shown in FIG. 1, the core is formed at its outer surface with protrusions. Usually the protrusions are formed integral with the core by furnishing a core mold having a negative protrusion pattern on its cavity surface and conventionally molding a core material in this mold. If desired, protrusions can be adhesively joined to the surface of a core. Then an intermediate layer is formed on the core having protrusions by injection molding or compression molding a suitable material around the core whereby the protrusions are embedded in the intermediate layer.

The material of which the intermediate layer is made is not critical and may be selected from both resin materials and rubber materials. For durability, high impact resin materials are preferred. Examples include polyester elastomers, polyurethane resins, ionomer resins, styrene elastomers, hydrogenated butadiene resins, and mixtures thereof. Such materials are commercially available as Hytrel 3078, 4047 and 4767 from Toray Dupont K.K. Of these, polyester elastomers and polyurethane resins are especially preferred.

The intermediate layer preferably has a Shore D hardness of 10 to 50, especially 15 to 45.

Using a mold, the intermediate layer can be formed around the core by injection molding or compression molding.

Where the protrusions 4 are formed to extend radially inward from the cover 3 toward the core 1 (that is, the cover partially penetrates into the intermediate layer) as shown in FIG. 2, the intermediate layer is formed at its outer surface with recesses at the same time as it is molded. Usually the intermediate layer having a plurality of recesses in its outer surface is formed around the core by furnishing an intermediate layer mold having a negative recess pattern on its cavity surface and conventionally molding an intermediate layer material in this mold. In an alternative procedure, after the intermediate layer is formed around the core, the intermediate layer can be formed with recesses as by drilling or engraving. Then a cover is formed on the intermediate layer having recesses by injection molding or compression molding a suitable material around the intermediate layer whereby the cover protrusions are embedded in the intermediate layer.

The material of which the cover 3 is made is not critical. A choice may be made of well-known cover stocks, for example, ionomer resins, polyurethane resins, polyester resins, and balata rubber. Ionomer resins are preferred. Commercially available ionomer resins such as Surlyn (E. I. Dupont) and Himilan (Mitsui Dupont Polychemical K.K.) are useful.

Additives such as titanium dioxide and barium sulfate may be added to the cover stock for adjusting the specific gravity and other properties thereof. Other optional additives include UV absorbers, antioxidants, and dispersants such as metal soaps. The cover may have a single layer structure of one material or be formed to a multilayer structure from layers of different materials.

Preferably the cover has a thickness (excluding the protrusions) of 0.5 to 4.0 mm, more preferably 1.0 to 2.5 mm and a Shore D hardness of 40 to 70, more preferably 50 to 65.

It is recommended for the golf ball of the invention that the hardness of the intermediate layer is lower than that of the solid core or cover which is provided with protrusions, preferably by at least 6 units, more preferably by at least 8 units, most preferably by 10 to 50 units as expressed in Shore D hardness. Where the solid core or cover is of multilayer structure, the hardness of the outermost layer of the solid core or the hardness of the innermost layer of the cover may be adjusted to the above-mentioned Shore D hardness.

The golf ball has a multiplicity of dimples in its surface. The ball on its surface is subject to finishing treatments such as painting and stamping, if necessary. The golf ball as a whole preferably has a hardness corresponding to a deflection of 2.6 to 4.0 mm, more preferably 2.8 to 3.8 mm, under a load of 100 kg. The golf ball must have a diameter of not less than 42.67 mm and a weight of not greater than 45.93 grams in accordance with the Rules of Golf.

EXAMPLE

Examples of the invention are given below by way of illustration and not by way of limitation. All parts are by weight.

Examples 1–6 & Comparative Examples 1–4

Solid cores A to E were formed by working rubber compositions of the formulation shown in Table 1 in a kneader and molding and vulcanizing them in molds at a temperature of 155° C. for about 15 minutes. Intermediate layer-forming compositions of the formulation shown in Table 2 were worked and then injection molded over the cores in the combination shown in Table 3. Around the intermediate layers, cover stocks of the formulation shown in Table 2 were injection molded in the combination shown in Table 3. Paint was conventionally applied, obtaining three-piece golf balls of Examples 1–6 and Comparative Examples 1–4.

In Examples 1–6 and Comparative Examples 3–4, the mold for the intermediate layer had on its cavity-defining inner surface a plurality of protrusions having the number and shape shown in Table 3 distributed in a regular octahedral arrangement. As a consequence, the intermediate layer had a plurality of recesses in its surface when it was molded. When molded, the cover stock penetrated into the recesses to form protrusions which were embedded in the intermediate layer.

These golf balls were examined for hardness, flight performance and feel by the following tests. The results are shown in Table 4.

Ball Hardness

Hardness is expressed by a deflection (mm) under a load of 100 kg.

Flight Performance

Using a swing robot, the golf ball was struck with different clubs at different head speeds. A spin rate, carry, total distance, and roll were measured.

(1) driver, head speed 45 m/s (W#1/HS45), 11°

(2) driver, head speed 35 m/s (W#1/HS35), 14°

(3) No. 5 iron, head speed 39 m/s (I#5/HS39)

(4) No. 9 iron, head speed 35 m/s (I#9/HS35)

The driver club used was Tour Stage X100, and the iron club was Tour Stage X1000, both available from Bridgestone Sports Co., Ltd.

Feel

The balls were hit by three professional golfers using a driver and pitching wedge. The feel of the balls upon impact was rated by the golfers according to the following criteria.

Exc.: excellent feel

Good: good feel

Fair: ordinary feel

Poor: unpleasant feel

TABLE 1

| | Core | | | | |
|---|---|---|---|---|---|
| Rubber compound | A | B | C | D | E |
| JSR BR01 | 100.0 | 100.0 | 100.0 | 100.0 | 100.0 |
| Zinc acrylate | 20.0 | 20.0 | 25.0 | 25.0 | 25.0 |
| Zinc oxide | 10.0 | 10.0 | 10.0 | 10.0 | 10.0 |
| Barium sulfate | 10.2 | 17.4 | 10.1 | 6.7 | 14.5 |
| Dicumyl peroxide | 1.2 | 1.2 | 1.2 | 1.2 | 1.2 |

JSR BR01 is the trade name of polybutadiene rubber by Japan Synthetic Rubber K.K.

TABLE 2

| | Intermediate layer/Cover | | | | |
|---|---|---|---|---|---|
| Resin blend (pbw) | 1 | 2 | 3 | 4 | 5 |
| Hytrel 3078 | 100.0 | — | — | — | — |
| Hytrel 4047 | — | 100.0 | — | — | — |
| Hytrel 4767 | — | — | 100.0 | — | — |
| Himilan 1605 | — | — | — | 50.0 | — |
| Himilan 1650 | — | — | — | — | 40.0 |
| Himilan 1706 | — | — | — | 50.0 | — |
| Surlyn 8120 | — | — | — | — | 60.0 |
| Titanium oxide | — | — | — | 5.0 | 5.0 |

Hytrel is the trade name of polyester base thermoplastic elastomer by Toray Dupont K.K.;
Himilan is the trade name of ionomer resin by Mitsui Dupont Polychemical K.K.; and
Surlyn is the trade name of ionomer resin by E. I. Dupont.

TABLE 3

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Core | | | | | | | | | | |
| Compound | A | B | C | B | C | D | B | C | D | C |
| Diameter (mm) | 36.3 | 30.5 | 35.3 | 35.3 | 37.1 | 28.3 | 30.5 | 35.3 | 28.3 | 37.1 |
| Weight (g) | 28.4 | 17.5 | 26.4 | 26.1 | 30.7 | 13.9 | 17.5 | 26.4 | 13.2 | 30.7 |
| Specific gravity | 1.134 | 1.176 | 1.147 | 1.132 | 1.147 | 1.172 | 1.176 | 1.147 | 1.115 | 1.147 |
| Hardness* (mm) | 4.1 | 3.9 | 3.5 | 3.9 | 3.5 | 3.4 | 3.9 | 3.5 | 3.9 | 3.5 |
| Intermediate layer | | | | | | | | | | |
| Blend | 3 | 1 | 2 | 1 | 2 | 2 | 1 | 2 | 1 | 2 |
| Diameter** (mm) | 40.3 | 38.5 | 40.3 | 40.3 | 40.3 | 40.3 | 38.5 | 40.3 | 40.3 | 40.3 |
| Thickness (mm) | 2.0 | 4.0 | 2.5 | 2.5 | 1.6 | 6.0 | 4.0 | 2.5 | 6.0 | 1.6 |
| Weight** (g) | 39.0 | 34.7 | 39.0 | 39.0 | 39.1 | 39.0 | 34.7 | 39.0 | 39.0 | 39.1 |
| Specific gravity | 1.15 | 1.15 | 1.12 | 1.15 | 1.12 | 1.12 | 1.15 | 1.12 | 1.15 | 1.12 |
| Hardness* (mm) | 3.7 | 3.9 | 3.3 | 3.4 | 3.7 | 3.3 | 3.9 | 3.3 | 3.8 | 3.7 |
| Shore D hardness | 47 | 30 | 40 | 30 | 40 | 40 | 30 | 40 | 30 | 40 |
| Cover | | | | | | | | | | |
| Blend | 4 | 4 | 5 | 5 | 5 | 5 | 4 | 5 | 4 | 5 |
| Thickness (mm) | 1.2 | 2.1 | 1.2 | 1.2 | 1.2 | 1.2 | 2.1 | 1.2 | 1.2 | 1.2 |
| Weight (g) | 6.3 | 10.6 | 6.3 | 6.3 | 6.3 | 6.3 | 10.6 | 6.3 | 6.3 | 6.3 |
| Specific gravity | 0.97 | 0.97 | 0.97 | 0.97 | 0.97 | 0.97 | 0.97 | 0.97 | 0.97 | 0.97 |
| Shore D hardness | 62 | 62 | 52 | 52 | 52 | 52 | 62 | 52 | 62 | 52 |
| Protrusions | | | | | | | | | | |
| Number | 344 | 152 | 344 | 152 | 80 | 120 | — | — | 344 | 54 |
| Cross-section | circular | circular | circular | circular | circular | circular | — | — | circular | circular |
| Cross-section size (mm) | 1.0 | 1.0 | 1.0 | 1.5 | 2.0 | 2.5 | — | — | 2.5 | 2.0 |
| Length L (mm) | 2.0 | 4.0 | 2.5 | 2.5 | 1.6 | 6.0 | — | — | 6.0 | 1.6 |
| Distance X (mm) | 3.6 | 5.3 | 3.6 | 5.5 | 7.7 | 6.3 | — | — | 3.6 | 9.5 |
| X/L | 1.8 | 1.3 | 1.4 | 2.2 | 4.8 | 1.0 | — | — | 0.6 | 5.9 |
| Ball | | | | | | | | | | |
| Diameter (mm) | 42.7 | 42.7 | 42.7 | 42.7 | 42.7 | 42.7 | 42.7 | 42.7 | 42.7 | 42.7 |
| Weight (g) | 45.3 | 45.3 | 45.3 | 45.3 | 45.4 | 45.3 | 45.3 | 45.3 | 45.3 | 45.4 |
| Hardness* (mm) | 3.0 | 3.1 | 3.2 | 3.5 | 3.2 | 3.2 | 3.1 | 3.2 | 3.1 | 3.2 |

*deflection (mm) under a load of 100 kg
**value for core and intermediate layer combined

TABLE 4

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| W#1/HS45/11° | | | | | | | | | | |
| Spin (rpm) | 2920 | 2760 | 2790 | 2760 | 2850 | 2690 | 2930 | 3140 | 3080 | 3170 |
| Carry (m) | 215.3 | 214.9 | 215.7 | 214.6 | 212.8 | 213.1 | 212.9 | 209.0 | 209.7 | 208.6 |
| Total (m) | 220.6 | 223.5 | 223.2 | 222.4 | 223.1 | 219.8 | 218.7 | 215.8 | 217.1 | 218.2 |
| W#1/HS35/14° | | | | | | | | | | |
| Spin (rpm) | 4360 | 4130 | 4160 | 4100 | 4410 | 4010 | 4360 | 4690 | 4410 | 4520 |
| Carry (in) | 142.7 | 141.2 | 141.5 | 140.8 | 143.4 | 139.7 | 139.7 | 137.1 | 138.1 | 140.5 |
| Total (m) | 158.4 | 160.4 | 160.2 | 159.1 | 159.7 | 157.2 | 156.0 | 154.3 | 154.7 | 154.8 |
| I#5/HS39 | | | | | | | | | | |
| Spin (rpm) | 6590 | 6270 | 6230 | 6200 | 6470 | 6150 | 5900 | 6120 | 5630 | 6160 |
| Carry (m) | 153.9 | 155.3 | 155.1 | 154.8 | 153.6 | 154.7 | 156.8 | 154.1 | 156.2 | 154.7 |
| Total (m) | 156.9 | 159.7 | 159.0 | 159.2 | 157.2 | 158.9 | 163.5 | 159.8 | 162.4 | 160.3 |
| Roll (m) | 3.0 | 4.4 | 3.9 | 4.4 | 3.6 | 4.2 | 6.7 | 5.7 | 6.2 | 5.6 |
| I#9/HS35 | | | | | | | | | | |
| Spin (rpm) | 9570 | 9210 | 9090 | 9070 | 9480 | 9030 | 8200 | 8900 | 8100 | 8950 |
| Carry (m) | 124.0 | 125.2 | 124.9 | 125.0 | 124.3 | 124.7 | 125.4 | 124.2 | 127.0 | 124.7 |
| Total (m) | 125.2 | 127.2 | 127.1 | 126.9 | 126.2 | 126.4 | 131.5 | 127.5 | 131.8 | 127.9 |
| Roll (m) | 1.2 | 2.0 | 2.2 | 1.9 | 1.9 | 1.7 | 6.1 | 3.3 | 4.8 | 3.2 |
| Feel | | | | | | | | | | |
| Driver | Exc. | Good | Exc. | Good | Exc. | Fair | Fair | Good | Poor | Good |
| Pitching wedge | Exc. | Exc. | Exc. | Exc. | Exc. | Good | Poor | Poor | Poor | Poor |

There has been described a golf ball of the construction that the spacing X and length L of protrusions which extend from the solid core or cover into the intermediate layer are selected so as to optimize the buckling phenomenon of protrusions. When the ball is hit with a driver at a relatively high head speed, the ball is largely deformed, which provides a reduced backspin rate and an increased launch angle, resulting in an increased carry. When the ball is hit with a short iron at a relatively low head speed, the backspin rate is increased and the ball is easier to control. With respect to the feel of the ball when hit, the ball gives a pleasant feel, that is, a soft feel upon driver shots and a tight, full-body feel upon short iron shots.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising: a solid core, an intermediate layer, and a cover, wherein the cover is provided with a plurality of protrusions penetrating into the intermediate layer, the protrusions are spaced apart a distance X (mm) from each other and have a length L (mm), and those protrusions satisfying $L \leqq X \leqq 5L$ account for at least 60% of the entire protrusions, and said plurality of protrusions has a higher hardness than the intermediate layer, with a hardness difference being at least 6 Shore D hardness units, and a ratio of the protrusion length to an intermediate layer thickness is 0.6 to 1.0, wherein a material of said cover is selected from a group consisting of:

ionomer resins, polyurethane resins, polyester resins, and balata rubber.

2. The golf ball of claim 1 wherein the protrusions have a length L of 1 to 6 mm.

3. The golf ball of claim 1 wherein the protrusions have a maximum size in cross section of 0.5 to 5 mm.

4. The golf ball of claim 1 wherein the solid core is formed mainly of 1,4-cis-polybutadiene, and the intermediate layer is formed mainly of a polyester elastomer or polyurethane resin.

5. The golf ball of claim 1, wherein 80% of said protrusions satisfy $L \leqq X \leqq 3L$.

6. The golf ball of claim 1, wherein said protrusions have the length L of 1 to 4 mm.

7. The golf ball of claim 1, wherein said protrusions have a maximum size in cross-section of 1 to 3 mm.

8. The golf ball of claim 1, wherein said intermediate layer thickness is in a range of 1.0 to 7.0 mm.

9. The golf ball of claim 1, wherein the ratio of protrusion length to the thickness of said intermediate layer is in the range of 0.4 to 1.0.

10. The golf ball of claim 1, wherein a number of protrusions is in a range of 75 to about 500.

11. The golf ball of claim 1, wherein said solid core has a diameter in a range of 28 to 38 mm.

12. The golf ball of claim 1, wherein said solid core has a Shore D hardness in a range of 20 to 50.

13. The golf ball of claim 1, wherein said intermediate layer has a Shore D hardness in a range of 10 to 50.

14. The golf ball of claim 1, wherein said cover has a thickness in a range of 0.5 to 4.0 mm.

15. The golf ball of claim 1, wherein said cover has a Shore D hardness in a range of 40 to 70.

16. The golf ball of claim 1, wherein the ratio of the protrusion length to the intermediate layer thickness is 1.0.

17. The golf ball of claim 1, wherein the intermediate layer is made of a resinous material.

* * * * *